US010487384B2

(12) United States Patent
Imano et al.

(10) Patent No.: US 10,487,384 B2
(45) Date of Patent: Nov. 26, 2019

(54) NI-BASED ALLOY PRODUCT AND METHOD FOR PRODUCING SAME, AND NI-BASED ALLOY MEMBER AND METHOD FOR PRODUCING SAME

(71) Applicant: Mitsubishi Hitachi Power Systems, Ltd., Nishi-ku, Yokohama (JP)

(72) Inventors: Shinya Imano, Yokohama (JP); Hironori Kamoshida, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 531 days.

(21) Appl. No.: 14/905,075

(22) PCT Filed: Jul. 17, 2013

(86) PCT No.: PCT/JP2013/069367
§ 371 (c)(1),
(2) Date: Jan. 14, 2016

(87) PCT Pub. No.: WO2015/008343
PCT Pub. Date: Jan. 22, 2015

(65) Prior Publication Data
US 2016/0160334 A1 Jun. 9, 2016

(51) Int. Cl.
*C22F 1/10* (2006.01)
*C21D 1/84* (2006.01)
(Continued)

(52) U.S. Cl.
CPC ..... *C22F 1/10* (2013.01); *C21D 1/84* (2013.01); *C21D 9/0068* (2013.01);
(Continued)

(58) Field of Classification Search
CPC ..... C22C 19/05; C22C 19/007; C22F 1/10
See application file for complete search history.

(56) References Cited

U.S. PATENT DOCUMENTS 4,574,015 A 3/1986 Genereux et al.
4,820,353 A 4/1989 Chang
(Continued)

FOREIGN PATENT DOCUMENTS

CN 1053094 A 7/1991
CN 1276022 A 12/2000
(Continued)

OTHER PUBLICATIONS

Chinese-language Office Action issued in counterpart Chinese Application No. 201380074789.9 dated May 31, 2016 with English translation (Seventeen (17) pages).
(Continued)

*Primary Examiner* — Colleen P Dunn
*Assistant Examiner* — Jeremy C Jones
(74) *Attorney, Agent, or Firm* — Crowell & Moring LLP

(57) ABSTRACT

There are provided: an Ni-based alloy member including a γ' phase precipitation with 36 to 60 volume % and exhibiting a high durable temperature and good cold workability; a method for producing the member; an Ni-based alloy product to be used as a precursor of the member; and a method for producing the product. The Ni-based alloy product has a two-phase structure composed of a γ phase and a γ' phase being incoherent to the γ phase, the incoherent γ' phase being present at a ratio of 20 volume % or higher. The Ni-based alloy member produced by cold working the Ni-based alloy product and subsequently by conducting heat treatment comprises a γ phase and a γ' phase being coherent to the γ phase, the coherent γ' phase being present at a ratio of 36 to 60 volume %, and has a predetermined shape.

6 Claims, 5 Drawing Sheets

(51) Int. Cl.

| | |
|---|---|
| ***C21D 9/00*** | (2006.01) |
| ***C22C 19/05*** | (2006.01) |
| ***C22C 19/00*** | (2006.01) |

(52) U.S. Cl.
CPC ..... *C22C 19/007* (2013.01); *C22C 19/05* (2013.01); *C22C 19/056* (2013.01); *C22C 19/058* (2013.01)

(56) References Cited

U.S. PATENT DOCUMENTS

| | | | | |
|---|---|---|---|---|
| 5,120,373 | A | 6/1992 | Miller et al. | |
| 5,131,961 | A | 7/1992 | Sato et al. | |
| 5,605,584 | A | 2/1997 | DeLuca et al. | |
| 5,649,280 | A | 7/1997 | Blankenship et al. | |
| 5,759,305 | A | 6/1998 | Benz et al. | |
| 6,059,904 | A | 5/2000 | Benz et al. | |
| 8,083,124 | B1 * | 12/2011 | Darolia ..... | B23K 20/023 228/194 |
| 2005/0265887 | A1 | 12/2005 | Toji et al. | |
| 2010/0243111 | A1 * | 9/2010 | Imano ..... | C22C 1/002 148/675 |
| 2011/0223055 | A1 | 9/2011 | Semba et al. | |
| 2015/0368774 | A1 | 12/2015 | Ota et al. | |

FOREIGN PATENT DOCUMENTS

| | | | |
|---|---|---|---|
| EP | 0 260 513 | A2 | 3/1988 |
| EP | 0 361 524 | A1 | 4/1990 |
| EP | 0 433 072 | A1 | 6/1991 |
| EP | 0 787 815 | A1 | 8/1997 |
| EP | 2 330 225 | A1 | 6/2011 |
| JP | 63-145737 | A | 6/1988 |
| JP | 2-97634 | A | 4/1990 |
| JP | 9-302450 | A | 11/1997 |
| JP | 2006-9143 | A | 1/2006 |
| WO | WO 99/23265 | A1 | 5/1999 |
| WO | WO 2010/038826 | A1 | 4/2010 |

OTHER PUBLICATIONS

International Search Report (PCT/ISA/210) issued in PCT Application No. PCT/JP2013/069367 dated Sep. 3, 2013 with English translation (Four (4) pages).

Extended European Search Report issued in counterpart European Application No. 13889448.0 dated Jan. 2, 2017 (eight (8) pages).

* cited by examiner

NI-BASED ALLOY PRODUCT AND METHOD FOR PRODUCING SAME, AND NI-BASED ALLOY MEMBER AND METHOD FOR PRODUCING SAME

TECHNICAL FIELD OF THE INVENTION

The present invention relates to an Ni-based alloy product, an Ni-based alloy member produced of the Ni-based alloy product, a method for producing the Ni-based alloy product, and a method for producing the Ni-based alloy member.

DESCRIPTION OF BACKGROUND ART

How to improve thermal efficiency of high temperature devices, such as gas turbines and jet engines, is an important problem for many reasons including the need to reduce environmental impacts. An effective way of increasing thermal efficiency is to increase service temperatures.

Currently, a turbine inlet temperature of about 1300° C. is standard in a gas turbine. On the other hand, turbine components applicable to temperatures around 1700° C. are becoming commercially practical. Also, for gas turbine components such as turbine blades, Ni-based alloys of high heat-resistant superalloys are often used.

Meanwhile, high-strength Ni-based alloys applied to these gas turbines, jet engines, etc. derive their high mechanical strength from precipitating a γ' phase (gamma prime phase, $Ni_3Al$) therein. A γ' phase is coherent with a γ phase in crystalline lattice, and the γ' phase coherently precipitated in the γ phase (hereinafter referred to as a "coherent γ' phase") contributes greatly to the improvement in mechanical strength. In other words, the mechanical strength of Ni-based alloy members used in gas turbines, etc. can be improved by increasing the amount of the precipitated γ' phase. However, such high-strength Ni-based alloy members with a high content of the precipitated γ' phase have extremely poor cold workability due to their high hardness, and therefore high-strength Ni-based alloy members are not usually cold-worked.

For example, turbine blades mentioned above are produced of Ni-based alloys by precision forging, in which a γ' phase precipitate is present at a ratio of 36 to 60 volume %, and cold working is not carried out in the production process due to their high hardness.

On the other hand, as for combustor components produced by cold working, hardness can be reduced by using Ni-based alloys in which a γ' phase precipitate is present at a controlled ratio of 30 volume % or lower, thereby making cold working possible. However, such combustor components and other articles that can be cold-worked have lower mechanical strength than turbine blades or the like produced of Ni-based alloys including a γ' phase precipitate at a ratio of 36 to 60 volume %. And, such Ni-based alloys including a γ' phase precipitate of 30 volume % or lower are not adequate to fully satisfy requirements for the capability to tolerate increasingly high temperatures, as mentioned above.

As seen from the above, what is strongly needed in the art is to develop an Ni-based alloy member that is produced of an Ni-based alloy including a γ' phase precipitate of 36 to 60 volume % and having a high durable temperature and that further has good cold workability. Also, a method for producing such a member is required.

Patent Literature 1 discloses a method for making an Ni-based superalloy article having a controlled grain size from a forging preform. In Patent Literature 1, there is described a controlling method of a grain size of an Ni-based superalloy, comprising the steps of hot die forging as the initial forging operations and isothermal forging as the subsequent forging operations. With this controlling method, a uniform grain size of approximately ASTM 6 to 8 can be achieved by carrying out hot die forging for the initial upset followed by isothermal forging and, if necessary, subsolvus annealing to provide a microstructure suitable for supersolvus heat treatment. It also describes that the hot die forging causes partial or complete recrystallization of the microstructure, which facilitates superplastic deformation in the subsequent isothermal forging operations. Moreover, Examples disclosed in Patent Literature 1 include a description about grain sizes when heat treatment is applied at 1850° F., 1900° F., and 1925° F.

CITATION LIST

Patent Literatures

Patent Literature 1: Japanese Unexamined Patent Application Publication No. Hei 9(1997)-302450.

SUMMARY OF THE INVENTION

Problems to be Solved by the Invention

With the method for controlling the grain size of an Ni-based superalloy described in Patent Literature 1, a uniform grain size can be achieved, and in addition, superplastic deformation can be facilitated. However, this does not solve the above-mentioned problem, that is, does not make it possible to provide an Ni-based alloy member including a γ' phase precipitate at a ratio of 36 to 60 volume % and which has a high durable temperature and also has good cold workability. Furthermore, Patent Literature 1 does not provide a method for producing the Ni-based alloy member.

The present invention has been made in view of the above problems, and it is an objective to provide: an Ni-based alloy member in which a γ' phase precipitate is present at a ratio of 36 to 60 volume % and which has a high durable temperature and also has good cold workability; a method for producing the member; an Ni-based alloy product to be used as a precursor of the Ni-based alloy member; and a method for producing the product.

Solution to Problems

According to one aspect of the present invention, there is provided an Ni-based alloy product having a two-phase structure composed of a γ phase and a γ' phase that is incoherent with the γ phase in crystalline lattice parameters (hereinafter referred to as an "incoherent γ' phase"), in which the incoherent γ' phase is present at a ratio of 20 volume % or higher in the two-phase structure.

A hardness of the Ni-based alloy product can be decreased with increasing contents of the incoherent γ' phase, thereby facilitating cold working. More preferable precipitation ratio of the incoherent γ' phase is 25 volume % or higher. Also, the hardness is preferably 400 Hv or lower, more preferably 370 Hv or lower.

Moreover, in order to enhance ductility in cold working and improve cold workability, average grain size of the γ phase and the incoherent γ' phase is preferably 100 μm or smaller, more preferably 50 μm or smaller.

The same advantages of the invention can be obtained even when carbides and different phases such as an η (eta) phase are present besides the incoherent γ' phase. However, the total of such different phases is preferably 15 volume % or less.

Furthermore, the advantages of the present invention can be obtained even when some precipitates of a fine-grained coherent γ' phase are present in the γ phase. However, it is preferable that the amount of the coherent γ' phase be limited to a minimum.

The Ni-based alloy product according to the present invention is excellent in cutting machinability as well as in cold workability.

In order to produce the Ni-based alloy product according to the present invention, hot forging needs to be performed in a temperature range where the two phases of the γ phase and the incoherent γ' phase can coexist. The reason is not only to precipitate the incoherent γ' phase but also to obtain a fine microstructure by inhibiting the coarsening of the γ phase by the incoherent γ' phase.

The hot forging needs to be performed at temperatures equal to or higher than 1000° C., at which the mechanical strength of the incoherent γ' phase becomes lower. Furthermore, it is desirable that the incoherent γ' phase be present at a ratio of 10 volume % or higher during the hot forging.

After the forging, the hardness of the Ni-based alloy can be decreased by increasing the incoherent γ' phase, resulting in further enhanced hot workability.

In order to increase the incoherent γ' phase, it is effective to conduct homogenization heat treatment at a temperature equal to or higher than 1000° C. and within a temperature range where the two phases of the γ phase and the γ' phase coexist, preferably at a heating temperature of the final forging. And, after the homogenization heat treatment, it is effective to carry out slow cooling to a temperature 100° C. or more below the homogenization heat treatment temperature.

This slow cooling inhibits the precipitation of the coherent γ' phase into the γ phase, which makes it possible to increase the incoherent γ' phase.

A cooling rate of 100° C./h or slower is effective; a cooling rate of 50° C./h or slower is significantly effective; and a cooling rate of 20° C./h or slower is the most preferable.

Besides, an Ni-based alloy member according to the present invention is a Ni-based alloy member produced through cold working (including cutting machining), annealing, and solution and aging heat treatment of the Ni-based alloy product described above. And, the Ni-based alloy member comprises a γ phase and a coherent γ' phase, in which the coherent γ' phase is present at a ratio of 36 to 60 volume %, and has a predetermined shape.

When conducting solution heat treatment to redissolve the incoherent γ' phase into a matrix, it is effective to apply a heat treatment at temperatures above a temperature at which the incoherent γ' phase dissolves and becomes a solid solution completely. However, in the case where a grain size of the matrix becomes too coarse and the properties are degraded by the heat treatment, the coarsening of the crystalline grains can be inhibited by applying the solution heat treatment at temperatures at which the incoherent γ' phase remains to some extent. In this case, the amount of the residual incoherent γ' phase is preferably 10 volume % or less.

In addition, a method of an Ni-based alloy member according to the present invention includes the step of producing a precursor of an Ni-based alloy member that has a predetermined shape by cold-working the Ni-based alloy product produced by the method described above. The precursor of an Ni-based alloy member is subjected to solution and aging heat treatment so as to produce an Ni-based alloy member comprises a γ phase and a coherent γ' phase, wherein the coherent γ' phase is present at a ratio of 36 to 60 volume %.

Advantages of the Invention

According to an Ni-based alloy product and a method for producing the product of the present invention, the Ni-based alloy product produced by hot forging has a two-phase structure composed of a γ phase and a γ' phase that is incoherent with the γ phase, wherein the γ' phase is present at a ratio of 20 volume % or higher, which leads to excellent cold workability in the Ni-based alloy product. Also, according to an Ni-based alloy member and a method for producing the member of the present invention, by subjecting the above-mentioned Ni-based alloy product to cold working, forming it into a predetermined shape, and then subjecting it to solution and aging heat treatment, there can be obtained an Ni-based alloy member having a high durable temperature, in which the Ni-based alloy member comprises a γ phase and a coherent γ' phase, the coherent γ' phase being present at a ratio of 36 to 60 volume %.

DETAILED DESCRIPTION OF THE PREFERRED EMBODIMENTS

Preferred embodiments of an Ni-based alloy product, a method for producing the product, an Ni-based alloy member, and a method for producing the member according to the present invention will be described below with reference to the accompanying drawings.

(First Embodiment of Method for Producing Ni-Based Alloy Member)

Figure 1:
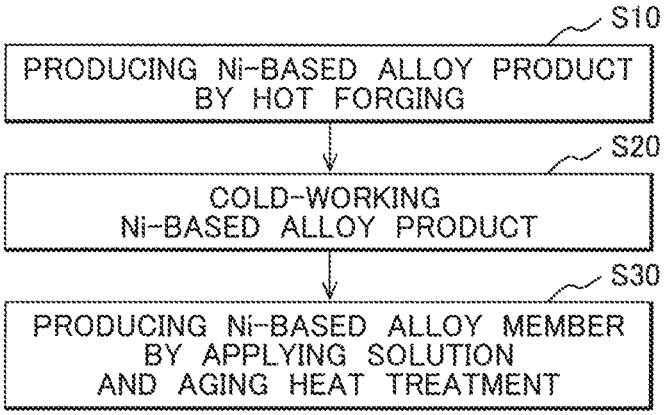
FIG. 1 is a flowchart showing a method for producing an Ni-based alloy member according to a first embodiment of the present invention.
Figure 2:
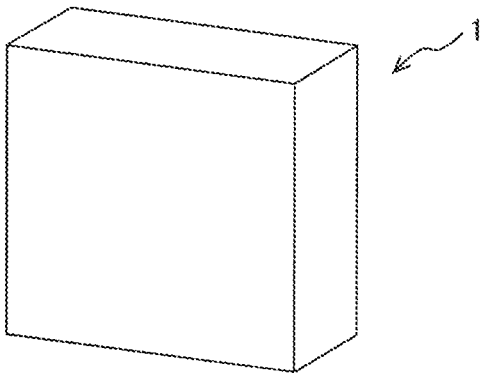
FIG. 2 is a schematic drawing showing a perspective view of an Ni-based alloy product according to an embodiment of the present invention.
Figure 3A:
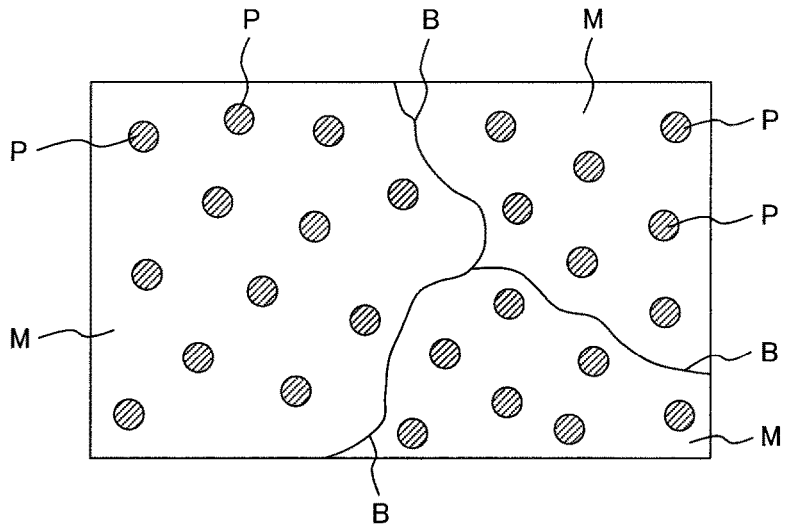
FIG. 3A is a schematic drawing showing a microstructure of an Ni-based alloy product as a comparative example.
Figure 3B:
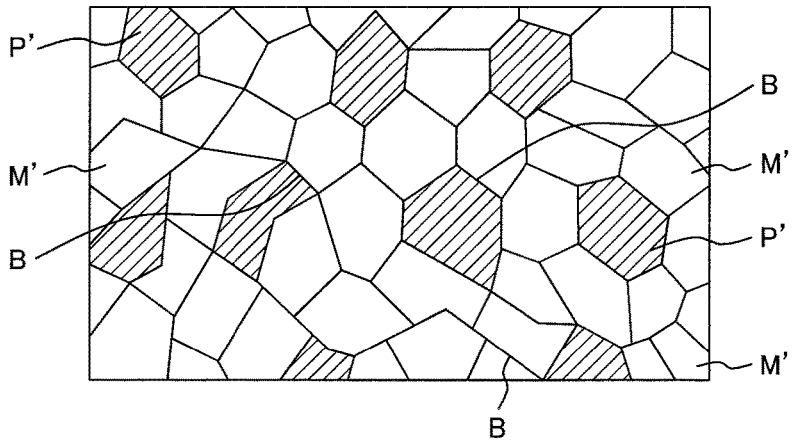
FIG. 3B is a schematic drawing showing a microstructure of an Ni-based alloy product after being subjected to hot forging as an inventive example.
Figure 3C:
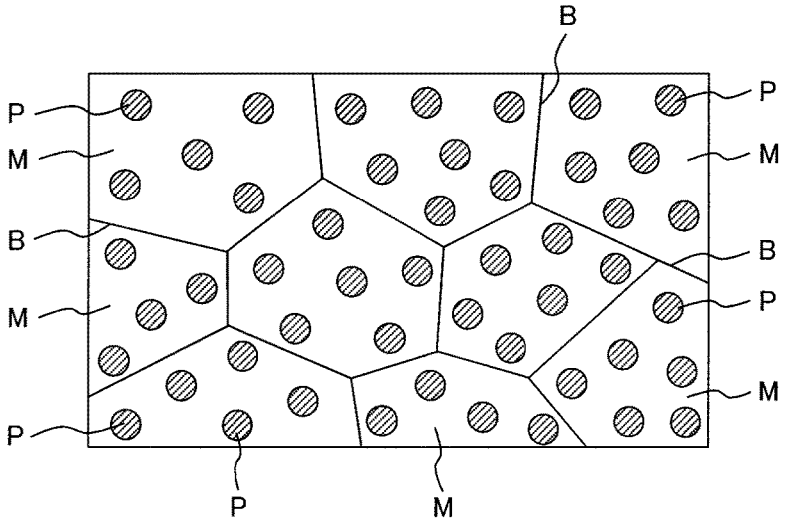
FIG. 3C is a schematic drawing showing a microstructure of an Ni-based alloy member obtained by subjecting a precursor of an Ni-based alloy member produced by cold-working the Ni-based alloy product of FIG. 3B to solution and aging heat treatment.

FIG. 1 is a flowchart showing a method for producing an Ni-based alloy member according to a first embodiment of the present invention, and FIG. 2 is a schematic drawing showing a perspective view of an Ni-based alloy product according to an embodiment of the present invention. Also, FIG. 3(*a*) is a schematic drawing showing a microstructure of an Ni-based alloy product as a comparative example; FIG. 3(*b*) is a schematic drawing showing a microstructure of an Ni-based alloy product after being subjected to hot forging as an inventive example, and FIG. 3(*c*) is a schematic drawing showing a microstructure of an Ni-based alloy member obtained by subjecting a precursor of an Ni-based alloy member produced by cold-working the Ni-based alloy product of FIG. 3(*b*) to solution and aging heat treatment.

In the method for producing an Ni-based alloy member shown in the flowchart of FIG. 1, first, an Ni-based alloy product to be a base material for an Ni-based alloy member is produced, and then an Ni-based alloy member is produced using this Ni-based alloy product.

An Ni-based alloy member produced by the production method according to the present invention is made up of a γ phase and a γ' phase that is coherent with the γ phase, wherein the γ' phase is present at a ratio of 36 to 60 volume %, and has a high durable temperature. More specifically, the object to be produced by the production method of the present invention is an Ni-based alloy member wherein a γ' phase that is thermodynamically stable in a temperature range of 700 to 900° C., in which the Ni-based alloy member is to be used, is present at a ratio of 36 to 60 volume %.

In producing an Ni-based alloy member of such high mechanical strength, first, an Ni-based alloy product (a product as a production base material for the Ni-based alloy member) that has a two-phase structure composed of a γ phase and an incoherent γ' phase, wherein the incoherent γ' phase is present at a ratio of 20 volume % or higher, is produced by hot-forging an Ni-based alloy material at a temperature equal to or higher than 1000° C. and at which the γ' phase is precipitated at a ratio of 10 volume % or higher (step S10 in FIG. 1). The Ni-based alloy material has an ingredient composition in which a γ' phase at a ratio of 36 to 60 volume % can be precipitated.

An example of the ingredient composition of the Ni-based alloy product would be 12% of Co, 14% of Cr, 3.7% of Al, 2.6% of Ti, 1% of Nb, 1% of W, 2% of Mo, 0.01% of C, and the balance of Ni (all in volume %), wherein an incoherent γ' phase is present at a ratio of 20 volume % or higher.

An Ni-based alloy product as an inventive example produced by hot forging has a microstructure shown in FIG. 3(*b*).

In FIG. 3(*b*), the γ phase M' and the incoherent γ' phase P' are completely different in crystal alignment, and their crystalline grains are located through the grain boundaries B of an incoherent interface. In other words, the incoherent γ' phase P' may be regarded as an excluded precipitate from a crystalline grain of the γ phase M'.

Incidentally, in the γ phase M', Ni and Al atoms are randomly arranged, but in the γ' phase P', Ni and Al atoms are regularly arranged. While both are based on a face-centered cubic lattice, they are different as precipitates.

For comparison with the microstructure of the Ni-based alloy product of the inventive example shown in FIG. 3(*b*), FIG. 3(*a*) is a schematic drawing showing a microstructure of an Ni-based alloy product as a comparative example produced without being subjected to hot forging.

As shown in FIG. 3(*a*), in the Ni-based alloy product produced without being subjected to hot forging, the γ' phase P is precipitated as an inclusion in a circular shape (a substantially circular shape) within the crystalline grains of the γ phase M, and the crystalline grains of the γ phase M are adjacent to each other via the grain boundaries B. Since the γ phase M and the γ' phase P are connected with each other without the grain boundaries B, a coherent interface would be formed on the interface between the two. In other words, this γ' phase P can be referred to as a coherent γ' phase P.

Meanwhile, a γ' phase generally has good lattice coherence with a γ phase of a matrix. Therefore, a γ' phase P precipitated within a crystalline grain of a γ phase M like FIG. 3(*a*) is coherent with the γ phase M.

The inventors came up with a technical idea in which this γ' phase P is not significantly higher in mechanical strength than the γ phase M, and that the coherent interface between the γ phase M and the γ' phase P would enhance the mechanical strength of an Ni-based alloy member.

In other words, the inventors considered that the presence of a coherent interface between a γ phase M and a γ' phase P, as shown in FIG. 3(*a*), results in poor cold workability of a high-strength Ni-based alloy member. Based on the above idea, the inventors have arrived at an innovative technical idea in that the formation of a microstructure having no coherent interface between the γ phase and the γ' phase at a stage prior to cold working can lower the mechanical strength and hardness of the Ni-based alloy member temporarily at the stage of cold working and thus improve its cold workability.

So, by carrying out hot forging or applying heat treatment after the hot forging at a temperature equal to or higher than 1000° C. and at which two phases of a γ phase and a γ' phase can coexist, there can be produced an Ni-based alloy product having a two-phase structure in which a γ phase M' and a γ' phase P' that is incoherent with the γ phase M' are aligned via incoherent grain boundaries B as shown in FIG. 3(*b*), instead of forming a coherent interface between a γ phase and a γ' phase like FIG. 3(*a*). And then, by subjecting a relatively soft Ni-based alloy product to cold working, it is made possible to facilitate the production of an Ni-based alloy member of a desired shape.

Referring back to FIG. 1, a precursor of an Ni-based alloy member of a desired shape is produced by cold-working an Ni-based alloy product 1 produced by hot forging (step S20).

Herein, "cold working" means working the Ni-based alloy product 1 into the shape of a desired final Ni-based alloy member by, for example, forging, rolling, or molding at a room temperature.

Because the Ni-based alloy product 1 used has the microstructure shown in FIG. 3(*b*) and is relatively soft, it has low mechanical strength at a room temperature and therefore exhibits excellent cold workability.

Enhancing ductility is effective in further improving this cold workability, and it is preferable that the crystalline grains of both the γ phase M' and the incoherent γ' phase P' that form the Ni-based alloy product 1 be adjusted to 100 μm or smaller in grain size. It is more preferable that they be adjusted to 50 μm or smaller in grain size.

Regarding this grain size, the inventors have proved that by performing step S10, namely, the step of hot-forging an Ni-based alloy base material at a temperature equal to or higher than 1000° C. and at which a γ' phase and a γ phase can coexist, a γ' phase that is incoherent with the γ phase is precipitated, and this precipitated γ' phase inhibits the grain growth of the γ phase. As a result, the grain size of both the γ phase and the γ' phase can be adjusted to 100 μm or smaller.

By this cold working, there is produced a precursor of an Ni-based alloy member that is a precursor of Ni-based alloy members such as plates, rod-shaped wires, and even turbine blades to be used as gas turbine components.

However, the precursor of an Ni-based alloy member produced in step S20 has a microstructure in which no coherent interface is present between the γ phase and the γ' phase to contribute to the enhancement of mechanical strength. Therefore, the precursor itself is not suitable for application as high-strength members.

Then, the precursor of an Ni-based alloy member is subjected to solution heat treatment so as to redissolve the incoherent γ' phase into a matrix. Subsequently, the precursor is subjected to aging heat treatment so as to precipitate a coherent γ' phase as an inclusion in the crystalline grains of the γ phase, which causes the formation of a coherent interface between the γ phase and the γ' phase. Thus there is produced an Ni-based alloy member that has the microstructure shown in FIG. 3(*c*) (see step S30).

Here, the microstructure shown in FIG. 3(*c*) contains a γ' phase P coherently precipitated within a γ phase M as a matrix, and has a coherent interface formed between the γ phase M and the γ' phase P, resulting in an Ni-based alloy member in which the γ' phase P that is thermodynamically stable is present at a ratio of 36 to 60 volume %.

Figure 4C:
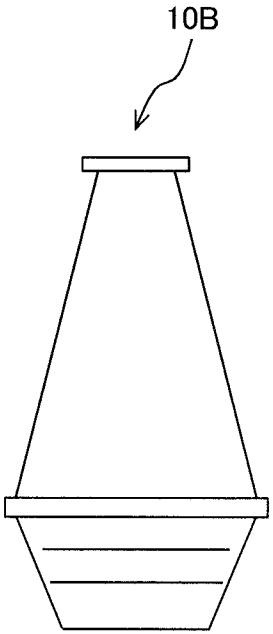
FIGS. 4A, 4B, and 4C each are a schematic drawings of an Ni-based alloy member according to an embodiment of the present invention.
Figure 4B:
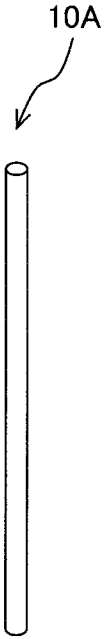
Figure 4A:
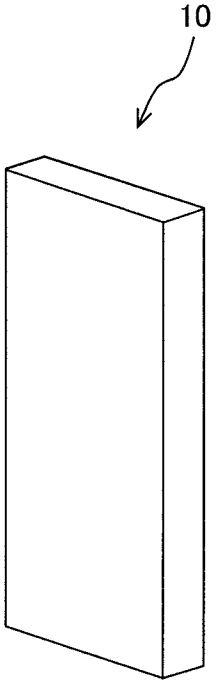

Examples of the Ni-based alloy member produced in step S30 are shown in FIGS. 4(*a*) to 4(*c*). The Ni-based alloy member 10 shown in FIG. 4(*a*) is a plate, the Ni-based alloy member 10A shown in FIG. 4(*b*) is a wire, and the Ni-based alloy member 10B shown in FIG. 4(*c*) is a turbine blade.

Each of these Ni-based alloy members 10, 10A and 10B contains a γ' phase at a ratio of 36 to 60 volume % or higher and has a high durable temperature due to a coherent interface formed between a γ phase and a γ' phase that is coherent with this γ phase.

As described above, according to the production flow shown in FIG. 1, an Ni-based alloy member that has a high durable temperature and is excellent in cold workability can be provided by the following steps: hot-forging a base material of a high-strength Ni-based alloy containing a γ' phase precipitate in an amount of 36 volume % or larger to exercise structure control to cause the precipitation of a γ' phase that is incoherent with the γ phase so as to produce an Ni-based alloy product that is relatively soft and excellent in cold workability; cold-working this Ni-based alloy product into a desired shape; and then subjecting it to solution and aging heat treatment to exercise structure control to cause the precipitation of a γ' phase that is coherent with the γ phase so as to produce a high-strength Ni-based alloy member. After the hot working, the Ni-based alloy product may be reheated to the final forging temperature for homogenization and then air-cooled before the cold working.

(Second Embodiment of Method for Producing Ni-Based Alloy Member)

Figure 5:
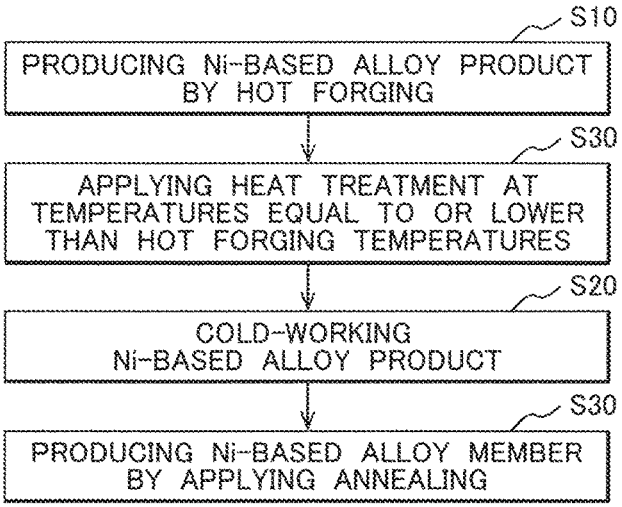
FIG. 5 is a flowchart showing a method for producing an Ni-based alloy member according to a second embodiment of the present invention.

FIG. 5 is a flowchart showing a method for producing an Ni-based alloy member according to a second embodiment of the present invention.

The production method for an Ni-based alloy member shown in FIG. 5 is a production method characterized in that it has an additional step of subjecting an Ni-based alloy product to heat treatment following the step S10 in which the Ni-based alloy product is produced by hot forging at a temperature equal to or higher than 1000° C. In this additional step, the Ni-based alloy product is subjected to homogenization heat treatment at a temperature equal to or higher than 1000° C. and at which the γ phase and the γ' phase coexist, and slow-cooled to a temperature 100° C. or more below the homogenization heat treatment temperatures (see step S10'). It is then cooled to a room temperature before being subjected to cold working.

For example, in the case where hot forging is performed at temperatures around 1200° C. in the initial stage and at around 1150° C. in the final stage, the subsequent heat treatment is applied for a predetermined time at a temperature around 1100° C., which is below the final stage temperature of the hot forging of about 1150° C., and then heat treatment is applied while controlling the temperature by slow-cooling the Ni-based alloy product to temperatures around 1000° C. or 900° C.

The inventors have revealed that by applying heat treatment after hot forging for a predetermined time at a temperature below the hot forging temperatures in the way described above, the incoherent γ' phase can be increased to further lower the hardness of the Ni-based alloy product, which results in further improved cold workability.

[Cold Workability Verification Tests and Results Thereof]

The inventors produced test pieces of different ingredient compositions under different production conditions and conducted tests to verify the cold workability of each test piece. Table 1 below shows the ingredient compositions of the test pieces, and Table 2 shows the production conditions of the test pieces and cold working test results. Also, as for the test pieces for which heat treatment was applied after hot forging during their production, the details of the heat treatments A, B and C in Table 2 are shown in Table 3.

TABLE 1

Ingredient Compositions of Test Pieces (vol. %).

| Test No. | Ni | Cr | Co | Mo | W | Ti | Al | C | B | Zr | Nb | Fe | Others |
|---|---|---|---|---|---|---|---|---|---|---|---|---|---|
| Comparative Example 1 | Balance | 16 | 15 | 3 | 1.3 | 4 | 2.8 | 0.025 | 0.018 | 0.03 | 0 | 0 | |
| Comparative Example 2 | Balance | 16 | 15 | 3 | 1 | 5 | 2.5 | 0.025 | 0.018 | 0.03 | 0 | 0 | |
| Comparative Example 3 | Balance | 13.5 | 20 | 2.8 | 1.2 | 5.8 | 2.3 | 0.015 | 0.015 | 0.03 | 0 | 0 | |
| Comparative Example 4 | Balance | 13.5 | 20 | 2.8 | 1.2 | 4.8 | 3 | 0.015 | 0.015 | 0.03 | 0 | 0 | |
| Comparative Example 5 | Balance | 16 | 5 | 4 | 3 | 4 | 2.7 | 0.01 | 0.001 | 0.003 | 0 | 0 | |
| Comparative Example 6 | Balance | 16 | 15 | 3 | 1.3 | 4.9 | 2.5 | 0.025 | 0.001 | 0.003 | 0 | 0 | |
| Inventive Example 1 | Balance | 13 | 0 | 5 | 0 | 5 | 2.7 | 0.002 | 0.018 | 0.04 | 0 | 0 | |

TABLE 1-continued

Ingredient Compositions of Test Pieces (vol. %).

| Test No. | Ni | Cr | Co | Mo | W | Ti | Al | C | B | Zr | Nb | Fe | Others |
|---|---|---|---|---|---|---|---|---|---|---|---|---|---|
| Inventive Example 2 | Balance | 16 | 10 | 0 | 4 | 3 | 3.6 | 0.001 | 0.009 | 0 | 0 | 5 | |
| Inventive Example 3 | Balance | 17 | 10 | 2 | 1 | 3 | 3.8 | 0.02 | 0.001 | 0.001 | 2 | 0 | 1.0Ta |
| Inventive Example 4 | Balance | 16 | 7 | 4 | 1 | 4 | 2.7 | 0.006 | 0.001 | 0.003 | 0 | 0 | 1.0Ta |
| Inventive Example 5 | Balance | 16 | 7 | 4 | 1 | 0.5 | 5 | 0.006 | 0.001 | 0.003 | 0.8 | 0 | 0.5Hf |
| Inventive Example 6 | Balance | 14 | 12 | 2 | 1 | 2.6 | 3.7 | 0.01 | 0.012 | 0.04 | 1 | 0 | |
| Inventive Example 7 | Balance | 18 | 26 | 0 | 0 | 1.8 | 4 | 0.04 | 0.02 | 0.02 | 2.2 | 2 | |
| Inventive Example 8 | Balance | 16 | 5 | 4 | 3 | 4 | 2.7 | 0.01 | 0.001 | 0.003 | 0 | 0 | |
| Inventive Example 9 | Balance | 16 | 15 | 3 | 1.3 | 4.9 | 2.5 | 0.025 | 0.001 | 0.003 | 0 | 0 | |
| Inventive Example 10 | Balance | 15.7 | 8.5 | 3.1 | 2.7 | 3.4 | 2.3 | 0.015 | 0.01 | 0.03 | 1.1 | 4 | |

TABLE 2

Production Conditions of Test Pieces and Cold Working Test Results.

| Test No. | Amount of γ' Phase at Service Temperature (700° C.) (vol. %) | Hot Forging Start Temperature (° C.) | Hot Forging End Temperature (° C.) | Heat Treatment after Hot Forging | Amount of Incoherent γ' Phase (vol. %) | Hardness before Cold Working (Hv) | Cold Working Test Result |
|---|---|---|---|---|---|---|---|
| Comparative Example 1 | 42 | Not performed | | — | — | 480 | NG |
| Comparative Example 2 | 45 | 1180 | 1180 | Not performed | 0 | 470 | NG |
| Comparative Example 3 | 46 | 1180 | 1180 | Not performed | 0 | 466 | NG |
| Comparative Example 4 | 47 | 1165 | 1180 | Not performed | 7 | 455 | NG |
| Comparative Example 5 | 42 | 1180 | 1180 | Not performed | 0 | 470 | NG |
| Comparative Example 6 | 44 | 1180 | 1150 | Not performed | 0 | 460 | NG |
| inventive Example 1 | 46 | 1180 | 1050 | Not performed | 20 | 365 | OK |
| inventive Example 2 | 47 | 1180 | 1000 | Not performed | 30 | 360 | OK |
| Inventive Example 3 | 45 | 1180 | 1050 | Not performed | 21 | 390 | OK |
| Inventive Example 4 | 43 | 1180 | 1000 | Not performed | 27 | 330 | OK |
| Inventive Example 5 | 47 | 1180 | 1150 | Heat treatment A | 30 | 365 | OK |
| Inventive Example 6 | 46 | 1150 | 1150 | Heat treatment B | 29 | 360 | OK |
| Inventive Example 7 | 43 | 1180 | 1150 | Heat treatment C | 35 | 320 | OK |
| Inventive Example 8 | 42 | 1180 | 1150 | Heat treatment A | 30 | 340 | OK |
| Inventive Example 9 | 44 | 1180 | 1150 | Heat treatment B | 32 | 325 | OK |
| Inventive Example 10 | 37 | 1180 | 1120 | Heat treatment B | 22 | 355 | OK |

TABLE 3

| | |
|---|---|
| Heat Treatment A | Held at 1100° C. for 1 hour, then cooled to 1000° C. at rate of 10° C./hour, and then water-cooled |
| Heat Treatment B | Held at 1100° C. for 1 hour, then cooled to 1000° C. at rate of 50° C./hour, then |

TABLE 3-continued

| | |
|---|---|
| | cooled to 950° C. at rate of 20° C./hour, and then air-cooled |
| Heat Treatment C | Held at 1100° C. for 1 hour, then cooled to 900° C. at rate of 5° C./hour, and then air-cooled |

In producing each test piece, the base material of 20 kg was melted by vacuum induction melting, subjected to homogenization heat treatment, and subsequently hot-forged under the conditions shown in Table 2 into a round bar with a diameter of 15 mm.

In Comparative Example 1, hot forging was not performed, whereas in Comparative Examples 2 to 6, hot forging was performed. Hot forging was performed also in Inventive Examples 1 to 10, and as for Inventive Examples 5 to 10, one of the heat treatments A to C shown in Table 3 was applied after the hot forging.

The microstructure of each test piece was observed after the hot forging or after the subsequent heat treatment, and the content ratios of the γ phase and the incoherent γ' phase were measured.

Furthermore, the cold working tests were conducted in the following procedure. First, each obtained round bar with a diameter of 15 mm was reduced in diameter 1 mm by 1 mm, by cold drawing. The cold drawing was performed three times until the diameter was reduced to 12 mm.

The cold working test results for the test pieces that could not be drawn successfully are denoted as "NG" in Table 2.

In contrast, the cold working test results for the test pieces that could be drawn successfully into a test piece with a diameter of 13 mm without cracking are denoted as "OK" in Table 2. Some test pieces were subsequently subjected to annealing at temperatures between 1000° C. and 1100° C. and cold working repeatedly to be successfully worked into a wire rod with a diameter of 3 mm.

As shown in Table 2, the cold working test results for test pieces of Comparative Examples 1 to 6 were all "NG", whereas the cold working test results for test pieces of Inventive Examples 1 to 10 were all "OK". In particular, it was easy to perform cold working of test pieces containing an incoherent γ' phase precipitate in an amount of 25% or larger and having a hardness of 370 Hv or lower.

As for test pieces of Comparative Examples 1 to 6, despite the hot forging performed, the amount of the incoherent γ' phase remained 0 volume %, resulting in a Vickers hardness (Hv) of over 400 before cold working, with which cold working was impossible. This is because, except for Comparative Example 4, the hot forging temperatures were higher than the solvus temperature of the γ' phase and therefore no γ' phase precipitation occurred during the hot forging. In Comparative Example 4, the hot forging temperatures were slightly lower than the solvus temperature of the γ' phase, and therefore an incoherent γ' phase was precipitated in a small amount, which, however, was not enough to improve cold workability. The solvus temperatures of the γ' phase of Comparative Examples 1 to 6 were 1134° C., 1157° C., 1183° C., 1173° C., 1115° C., and 1154° C., respectively.

In contrast, the Vickers hardness (Hv) of each test piece of Inventive Examples 1 to 10 was lower than 400, which permits cold working.

In particular, Inventive Examples 5 to 10, for which any one of the heat treatments A to C was applied after the hot forging, each exhibited a Vickers hardness (Hv) that was relatively low as compared with Inventive Examples 1 to 3, for which no heat treatment was applied after the hot forging.

As can be seen from the above, it has been demonstrated that the hardness of an Ni-based alloy product can be further lowered to further improve its cold workability by applying homogenization heat treatment at a temperature equal to or higher than 1000° C. and within a temperature range in which the γ phase and the γ' phase coexist after performing hot forging in the way described above and subsequently performing slow cooling to a temperature 100° C. or more below the homogenization heat treatment temperature.

Incidentally, test pieces of Inventive Examples 1 to 8 were successfully worked into a wire with a diameter of 2 mm by being subjected to annealing and cold drawing repeatedly after the first cold working test.

Figure 6:
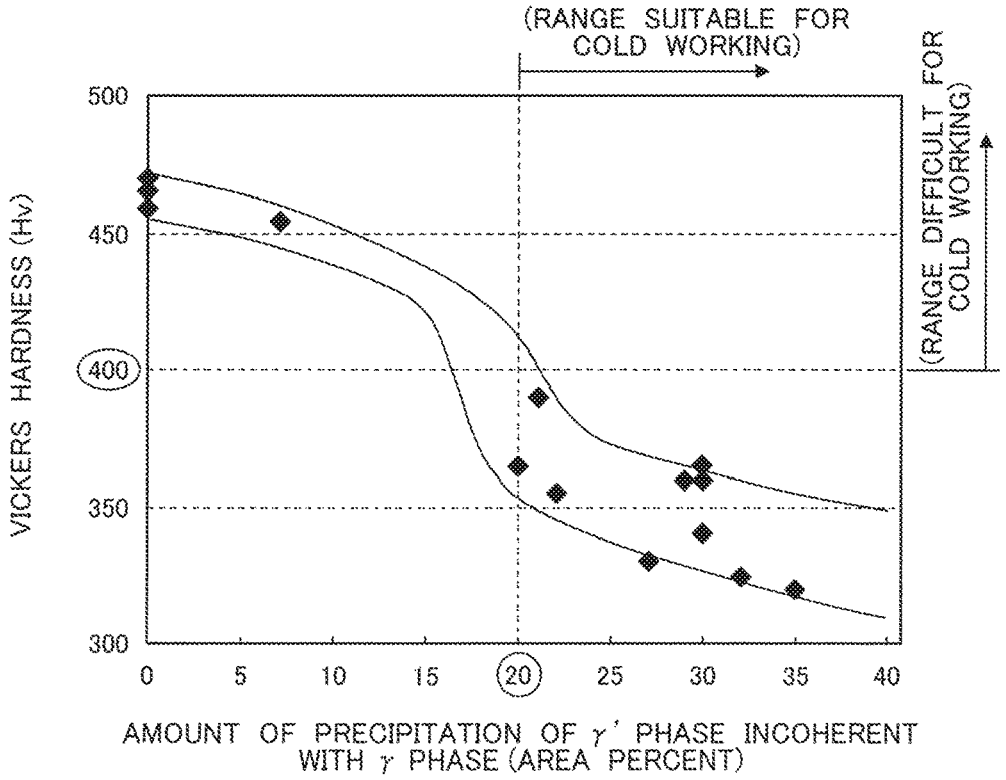
FIG. 6 is a graph showing test results that define an optimal range of the amount of a precipitated γ' phase that is incoherent with a γ phase in a hot forged Ni-based alloy product.

A relationship between the amount of the precipitated incoherent γ' phase and the Vickers hardness before the cold working in Table 2 is shown in a graph form in FIG. 6.

FIG. 6 teaches that the amount of precipitation of the incoherent γ' phase to the γ phase meets an inflection point at 20 volume %, and that the Vickers hardness greatly decreases in a range of the amount equal to or larger than 20 volume %. It also teaches that in this range of the amount equal to or larger than 20 volume %, the Vickers hardness is lower than 400 Hv, which indicates that cold working is possible. Based on these results, it has been determined that the amount of the precipitated incoherent γ' phase contained in an Ni-based alloy product produced by hot forging at a temperature equal to or higher than 1000° C. is defined to be 20 volume % or larger.

Figure 7:
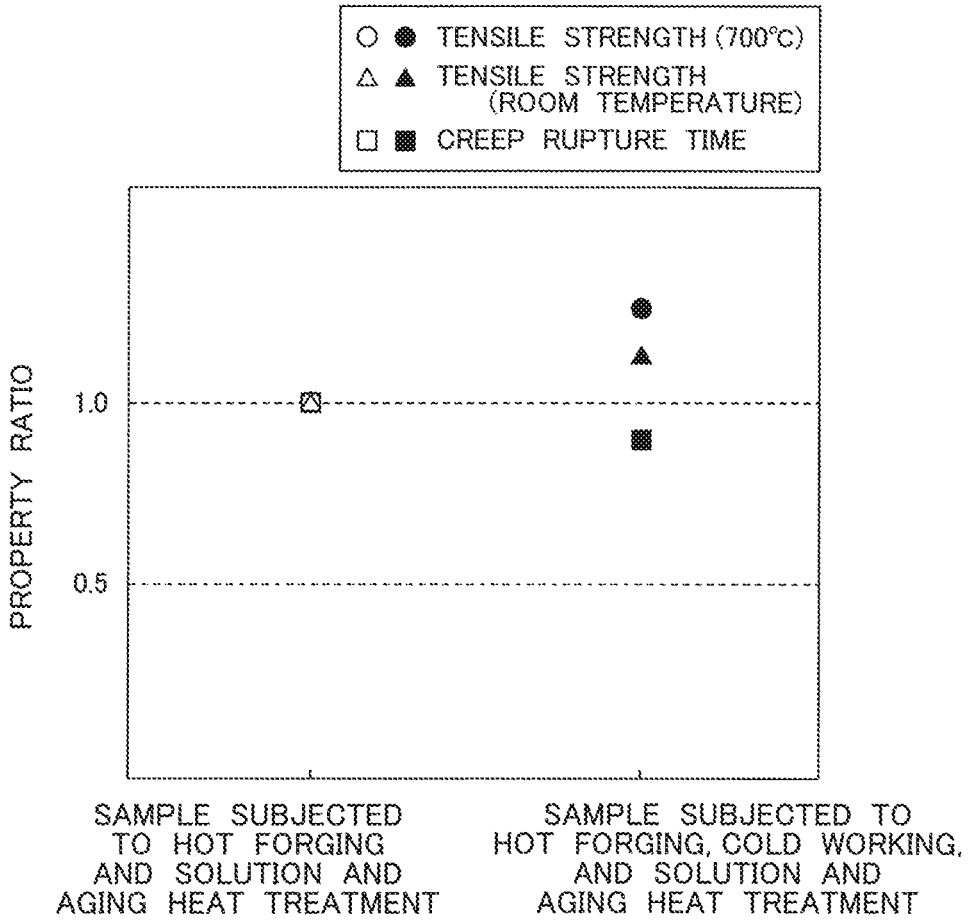
FIG. 7 is a graph showing a property ratio between a sample subjected to hot forging and solution and aging heat treatment and another sample subjected to hot forging, cold working, and solution and aging heat treatment.

FIG. 7 is a graph showing a property ratio between a sample subjected to hot forging and solution and aging heat treatment and another sample subjected to hot forging, cold working, and solution and aging heat treatment.

Here, tensile testing was conducted in two cases, at a room temperature and at 700° C. Also, creep testing was conducted at 700° C. and a load stress of 350 MPa.

FIG. 7 teaches that the two test pieces exhibit almost the same tensile property and creep property. Therefore, it has been found that an Ni-based alloy member produced by being subjected to hot forging followed by cold working and subsequently to solution and aging heat treatment as with the production method according to the present invention has a mechanical strength equivalent to that of another Ni-based alloy member produced by a production method in which cold working is not performed.

While the preferred embodiments of the present invention have been described above with reference to the accompanying drawings, it should be noted that the specific constitution is not to be construed as limited to the embodiments and that any design modifications, etc. made without departing from the spirit and scope of the present invention are to be included in the present invention.

LEGEND

1 . . . Ni-based alloy product; 10, 10A, 10B . . . Ni-based alloy member; B . . . grain boundary; M . . . γ phase (matrix); P . . . γ' phase (γ' phase coherent with γ phase); and P' . . . γ' phase (γ' phase incoherent with γ phase).

The invention claimed is:

1. An Ni-based alloy product, comprising:

an Ni-based alloy material having an ingredient composition, wherein a γ' phase at a ratio of 36 to 60 volume % can be precipitated, and wherein the γ' phase is thermodynamically stable in a temperature range of 700 to 900° C. at the ratio of 36 to 60 volume %, wherein the Ni-based alloy product has a two-phase structure composed of crystalline grains of a γ phase and crystalline grains of the γ' phase, wherein the γ' phase is an incoherent γ' phase being located through γ phase grain boundaries of an incoherent interface, wherein the incoherent γ' phase is present at a ratio of 20 volume % or higher in the two-phase structure, and wherein the Ni-based alloy product has a Vickers hardness equal to or less than 400 Hv.

2. The Ni-based alloy product according to claim 1, wherein each crystalline grain of the γ phase and the incoherent γ' phase is 100 μm or smaller in average grain size.

3. The Ni-based alloy product according to claim 2, wherein each crystalline grain of the γ phase and the incoherent γ' phase is 50 μm or smaller in average grain size.

4. The Ni-based alloy product according to claim 1, wherein the Ni-based alloy product has a Vickers hardness equal to or less than 370 Hv.

5. The Ni-based alloy product according to claim 1, wherein the total amount of different phases besides the incoherent γ' phase and the γ phase is 15 volume % or less.

6. An Ni-based alloy product having a γ' phase in a ratio of 36 to 60 volume percent, wherein the γ' phase is thermodynamically stable in a temperature range of 700 to 900° C., and wherein the γ' phase in a ratio of 36 to 60 volume percent can be precipitated, wherein the Ni-based alloy product has a two-phase structure composed of crystalline grains of a γ phase and crystalline grains of the γ' phase, wherein the γ' phase is an incoherent γ' phase being incoherent in crystalline lattice with the γ phase, the crystalline grains of the γ phase and the crystalline grains of the incoherent γ' phase being located through γ phase grain boundaries of an incoherent interface, wherein the γ' phase is present at a ratio of 20 volume % or higher in the two-phase structure, wherein the Ni-based alloy product has a Vickers hardness equal to or less than 400 Hv, and wherein the Ni-based alloy product is a production base material for an Ni-based alloy member.

* * * * *